US007870945B2

(12) United States Patent
Mileaf

(10) Patent No.: US 7,870,945 B2
(45) Date of Patent: Jan. 18, 2011

(54) PROCESS FOR SORTING OBJECTS

(75) Inventor: Daryl S. Mileaf, Hanover, MD (US)

(73) Assignee: Northrop Grumman Systems Corporation, Los Angeles, CA (US)

( * ) Notice: Subject to any disclaimer, the term of this patent is extended or adjusted under 35 U.S.C. 154(b) by 943 days.

(21) Appl. No.: 11/708,433

(22) Filed: Feb. 21, 2007

(65) Prior Publication Data

US 2007/0203612 A1 Aug. 30, 2007

Related U.S. Application Data

(60) Provisional application No. 60/776,207, filed on Feb. 24, 2006.

(51) Int. Cl.
*B07C 5/00* (2006.01)

(52) U.S. Cl. ..... 198/617; 198/431; 198/437; 198/572; 198/575; 198/580; 209/584; 209/900

(58) Field of Classification Search ..... 198/431, 198/437, 572, 575, 580, 617; 209/584, 900
See application file for complete search history.

(56) References Cited

U.S. PATENT DOCUMENTS

| | | | | |
|---|---|---|---|---|
| 3,880,298 | A | 4/1975 | Habegger et al. | |
| 5,009,321 | A | 4/1991 | Keoguh | |
| 5,588,520 | A | 12/1996 | Affaticati et al. | |
| 5,994,657 | A | 11/1999 | Maier | |
| 6,076,683 | A * | 6/2000 | Okada et al. | 209/656 |
| 6,107,588 | A | 8/2000 | De Leo | |
| 6,126,017 | A | 10/2000 | Hours | |
| 6,209,703 | B1 | 4/2001 | Soldavini | |
| 6,241,099 | B1 | 6/2001 | Hendrickson | |
| 6,274,836 | B1 | 8/2001 | Walach | |
| 6,276,509 | B1 | 8/2001 | Schuster | |

(Continued)

FOREIGN PATENT DOCUMENTS

FR 2 387 697 A 11/1978

(Continued)

OTHER PUBLICATIONS

International Search Report issued in International Application No. PCT/US07/04387 on Dec. 27, 2007, 4 pages.

(Continued)

*Primary Examiner*—Douglas A Hess
(74) *Attorney, Agent, or Firm*—Rothwell, Figg, Ernst & Manbeck, P.C.

(57) ABSTRACT

A method for sorting objects using a continuous loop conveyor sorting system having two or more feeders. In one embodiment, the method includes sorting a batch of objects to form a first group of objects and a second group of objects, using a first feeder to feed all of the objects from the first group onto the conveyor, using a second feeder to feed all of the objects from the second group onto the conveyor, removing the objects from the first group from the conveyor prior to the any of the objects reaching the point at which the second feeder feeds objects onto the conveyor, and removing the objects from the second group from the conveyor prior to the any of the objects reaching the point at which the first feeder feeds objects onto the conveyor.

14 Claims, 4 Drawing Sheets

U.S. PATENT DOCUMENTS

| | | | | |
|---|---|---|---|---|
| 6,316,741 | B1 | 11/2001 | Fitzgibbons | |
| 6,365,862 | B1 | 4/2002 | Miller | |
| 6,501,041 | B1 | 12/2002 | Burns | |
| 6,555,776 | B2 | 4/2003 | Roth | |
| 6,561,339 | B1 | 5/2003 | Olson | |
| 6,585,101 | B2 | 7/2003 | Edwards et al. | |
| 6,598,748 | B2 | 7/2003 | Mileaf | |
| 6,685,030 | B1 | 2/2004 | Mileaf | |
| 6,740,835 | B2 | 5/2004 | Steinmetz | |
| 6,741,908 | B2 | 5/2004 | Vanderbles | |
| 6,747,231 | B1 | 6/2004 | Bretschneider | |
| 6,748,294 | B1 | 6/2004 | Overman | |
| 6,762,384 | B1 | 7/2004 | Kechel | |
| 6,822,182 | B2 | 11/2004 | Kechel | |
| 6,881,916 | B2 | 4/2005 | McLaughlin | |
| 6,889,814 | B2 | 5/2005 | Cerutti et al. | |
| 6,907,982 | B2 | 6/2005 | Olson | |
| 6,921,875 | B2 | 7/2005 | Hanson | |
| 6,924,451 | B2 | 8/2005 | Hanson | |
| 6,926,271 | B2 | 8/2005 | Hanson | |
| 6,946,612 | B2 | 9/2005 | Morikawa | |
| 6,953,906 | B2 | 10/2005 | Burns | |
| 6,978,192 | B2 | 12/2005 | Wisniewski | |
| 7,004,396 | B1 | 2/2006 | Quine | |
| 7,006,891 | B2 | 2/2006 | Roth | |
| 7,012,211 | B2 | 3/2006 | Brinkley | |
| 7,121,398 | B2 * | 10/2006 | Affaticati et al. | 198/357 |
| 7,411,146 | B2 * | 8/2008 | Hanson et al. | 209/584 |
| 7,562,760 | B2 * | 7/2009 | Affaticati et al. | 198/357 |
| 2002/0125177 | A1 | 9/2002 | Burns | |
| 2002/0139727 | A1 | 10/2002 | Vanderbles | |
| 2003/0066736 | A1 | 4/2003 | Edwards et al. | |
| 2003/0116482 | A1 | 6/2003 | Steinmetz | |
| 2004/0035762 | A1 | 2/2004 | Brown | |
| 2005/0189271 | A1 | 9/2005 | Cerutti | |
| 2005/0205473 | A1 * | 9/2005 | Mileaf et al. | |

FOREIGN PATENT DOCUMENTS

| | | | |
|---|---|---|---|
| WO | WO 01/08817 | A1 | 2/2001 |
| WO | WO 02/090006 | A1 | 11/2002 |

OTHER PUBLICATIONS

Supplementary European Search Report issued in EP No. 07751166.5, dated Mar. 5, 2009, 4 pages.

* cited by examiner

PROCESS FOR SORTING OBJECTS

The present application claims the benefit of U.S. Provisional Patent Application No. 60/776,207, filed on Feb. 24, 2006, which is incorporated herein by this reference.

BACKGROUND

1. Field of the Invention

The present invention relates to systems and methods for sorting objects (e.g., parcels or other objects)

2. Discussion of the Background

There are numerous organizations that sort objects by some object attribute (e.g., purchase order, stock number, destination point or any number of other attributes of the object). In many cases, the sorting machines involved do not have enough sorting fidelity (e.g., number of outputs) to provide 100% sorting capacity within a single sorting process. Typically, this is addressed through the creation of primary and secondary sort plans designed to create one level of separation on the primary sort and then a finer degree of separation on the secondary sort(s).

In some cases, such as mail processing, matched sort plans are used to sequence the mail into a specific order such as the delivery sequence of the mail carrier. Typically, these are two, or three pass sorting operations.

Because it may take more than one sort to separate, or sequence, objects to the desired level of separation it is important that the base throughput of the sorting machinery be as high as possible to offset the time consumed in performing multiple passes, or sorts. For example, if a system operates at 30,000 objects per hour and must perform two sorts to create the sort fidelity required, then the operational throughput of the sorting process can be no better than 15,000 objects per hour (set up time, system sweeping and other 'overhead functions' degrade this further).

There are some sorting systems that are configured to produce throughputs higher than the base system with a simplified configuration (see e.g., U.S. Pat. No. 6,889,814). Usually, systems of this type have a continuous loop conveyor that has a first feeder (or "induction station") located at one "end" of the conveyor and a second feeder located at the opposite "end" of the conveyor. The feeders feed objects onto the conveyor, and the objects are then conveyed to an output section (or "discharge station") that is associated with the object. By feeding objects into the system at opposite ends of the system, the system has multiple opportunities to use the sorting mechanism (e.g., tilt tray, cross belt, carousel, or other sorting mechanism) as some of the objects are loaded at one end and sorted prior to reaching the second feeder allowing for an average of more than one sort per cycle of the carrying mechanism.

Configuring the sort plan such that the high volume sort locations are on one side of the machine can enable even higher utilization for the second set of feeders. Unfortunately, these types of system have limitations that are driven by the random nature of the material being presented to the feeders.

Ideally, one would like to process such a system at the theoretical maximum possible throughput (e.g., twice the base throughput for a system using two sets of feeders). In doing so, the system would be run at the maximum possible efficiency, operating at half the speed of a single feeder system and producing the same throughput. The capability to operate at slower processing speeds reduces the number of errors introduced into the process and minimizes potential damage to the product.

SUMMARY OF THE INVENTION

The present invention provides methods for sorting objects. In some embodiments, the methods employ a sorting system having a continuous loop conveyor and two or more feeders for depositing objects onto the conveyor.

In one embodiment, the method includes: (a) sorting a batch of objects to form a first group of objects and a second group of objects, (b) using a first feeder to feed all of the objects from the first group of objects onto the conveyor, (c) using a second feeder to feed all of the objects from the second group of objects onto the conveyor, (d) removing from the conveyor the objects from the first group of objects prior to the any of the objects reaching the point at which the second feeder feeds objects onto the conveyor, and (e) removing from the conveyor the objects from the second group of objects prior to the any of the objects reaching the point at which the first feeder feeds objects onto the conveyor.

The above and other features and advantages of the present invention, as well as the structure and operation of preferred embodiments of the present invention, are described in detail below with reference to the accompanying drawings.

BRIEF DESCRIPTION OF THE DRAWINGS

The accompanying drawings, which are incorporated herein and form part of the specification, illustrate various embodiments of the present invention. In the drawings, like reference numbers indicate identical or functionally similar elements.

DETAILED DESCRIPTION OF THE PREFERRED EMBODIMENT

Figure 1:
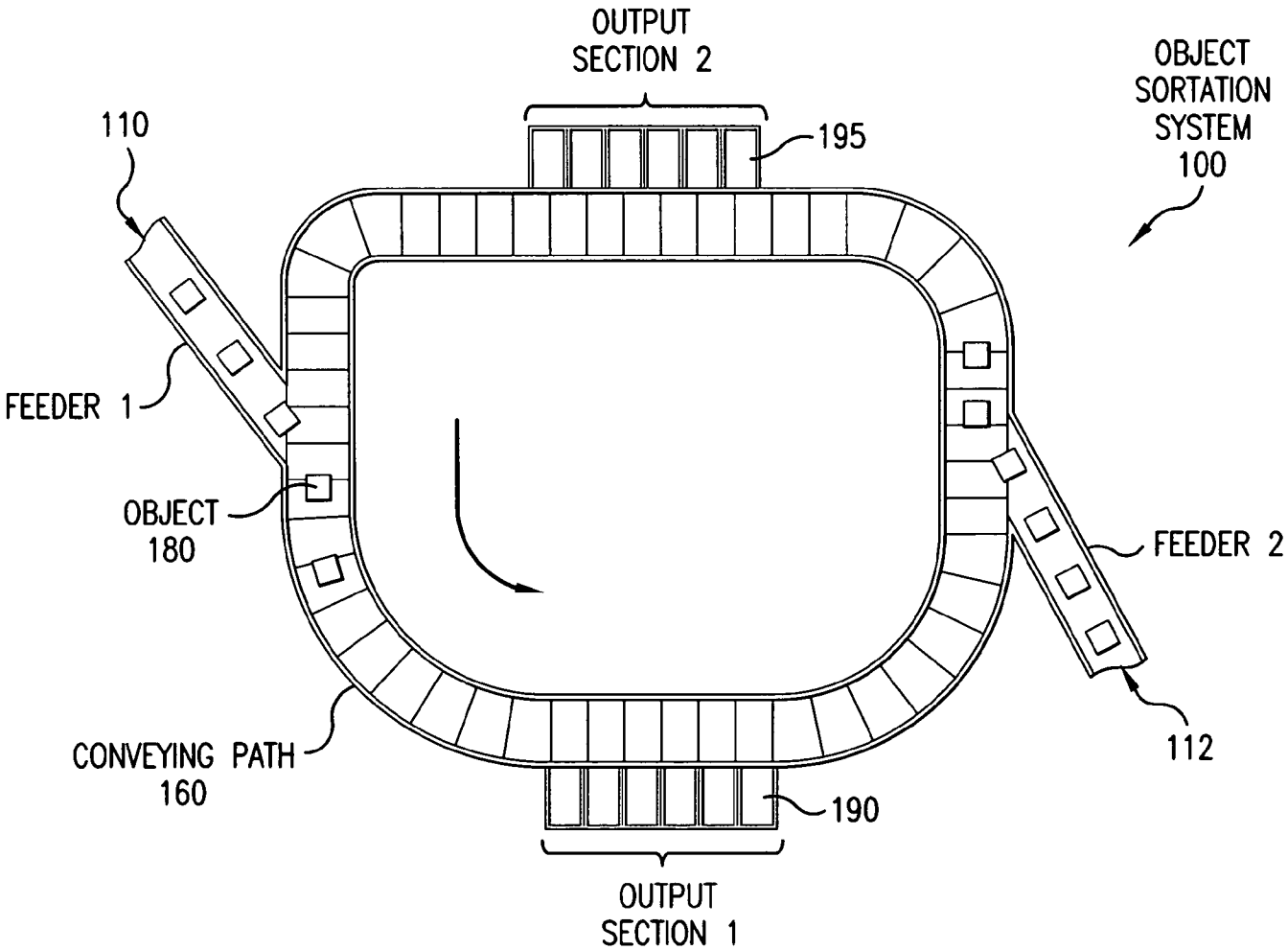
FIG. 1 illustrates an object sorting system 100 having multiple feeders.

FIG. 1 illustrates a conventional object sorting system 100 having multiple feeders. In the embodiment shown, system 100 includes: a continuous loop conveyor path 160, two feeders (feeder 1 and feeder 2) that feed objects onto the conveyor path 160, and two output sections (output section 1 and output section 2) that receive the objects placed onto the conveyor path.

Preferably, as shown, feeders 1 and 2 and output sections 1 and 2 are arranged around conveyor 160 so that (1) all objects 180 introduced onto conveyor 160 from feeder 1 will reach output section 1 prior to reaching the point at which feeder 2 introduces objects 180 onto conveyor 160, and all objects 180 introduced onto conveyor 160 from feeder 2 will reach output section 2 prior to reaching the point at which feeder 1 introduces objects 180 onto conveyor 160.

Conventionally, each object 180 placed onto the conveyor path 160 is assigned to only one of the output sections (a sort plan may be used to assign objects to output sections). For example, all objects that are to be shipped to New York City may be assigned to output section 1 and all objects to be shipped to Chicago may be assigned to output section 2. Thus, when an object to be shipped to New York City is placed on conveyor 160, the object will eventually be conveyed to output section 1, at which point the object is removed from conveyor 160 and placed, for example, into an output bin 190 of the first output section. Similarly, when an object to be shipped to Chicago is placed on conveyor 160, the object will eventually be conveyed to output section 2, at which point the object is removed from conveyor 160 and placed, for example, into an output bin 195 of the second output section. In this manner, the NYC objects can be separated from the Chicago objects.

Conventionally, system 100 is operated such that objects assigned to different output sections are introduced onto conveyor 160 using the same feeder. For example, in conventional sorting processes, borrowing from the example above, feeder 1 and/or feeder 2 may be used to place onto conveyor 160 the objects destined for NYC as well as the objects destined for Chicago. In such a situation, at least some of the objects will travel almost the entire conveyor loop before being removed from the conveyor. This is inefficient.

Figure 2:
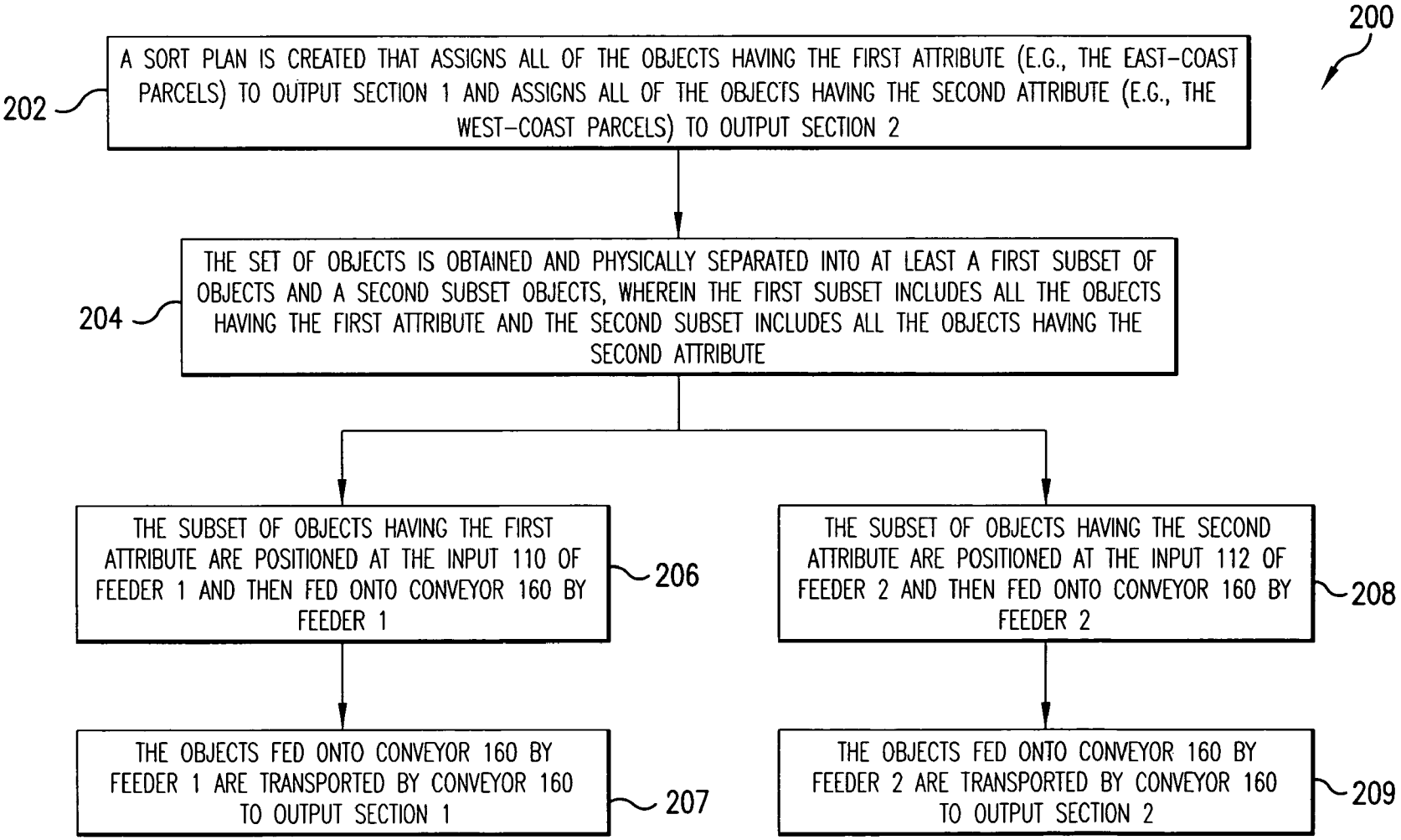
FIG. 2 is flow chart illustrating a process 200.

The present invention solves this inefficiency. Lets assume we have a generally randomly ordered set of objects, wherein the set of objects includes (1) a first subset of objects that share a first common attribute (e.g., parcels destined for a city on the East Coast) and (2) second first subset of objects that share a second common attribute (e.g., parcels destined for a city on the West Coast), and lets further assume that we want to place (1) all East Coast parcels into one of the outputs of output section 1 and (2) all of the West Coast parcels into one of the outputs of output section 2. Given this scenario, FIG. 2 is a flow chart illustrating a process 200 according to an embodiment of the invention.

In step 202, a sort plan is created that assigns all of the objects having the first attribute (e.g., the East Coast parcels) to output section 1 and assigns all of the objects having the second attribute (e.g., the West Coast parcels) to output section 2.

In step 204, the set of objects is obtained and physically separated into at least a first subset of objects and a second subset objects, wherein the first subset includes all the objects having the first attribute and the second subset includes all the objects having the second attribute.

In step 206, the subset of objects having the first attribute are positioned at the input 110 of feeder 1 and then fed onto conveyor 160 by feeder 1.

In step 207, the objects fed onto conveyor 160 by feeder 1 are transported by conveyor 160 to the output section 1. Because of the positions in which the feeders and output sections are arranged around conveyor 160, these objects will not pass the point at which feeder 2 places objects onto conveyor 160 because these objects are removed from conveyor at output section 1.

In step 208, the subset of objects having the second attribute are positioned at the input 112 of feeder 2 and then fed onto conveyor 160 by feeder 2.

In step 209, the objects fed onto conveyor 160 by feeder 2 are transported by conveyor 160 to output section 2. Because of the positions in which the feeders and output sections are arranged around conveyor 160, these objects will not pass the point at which feeder 1 places objects onto conveyor 160 because these objects are removed from conveyor at output section 2.

Process steps 206 and 207 may be performed at the same time as process steps 208 and 209.

The above process enables sorting system 100 to operate at an improved fidelity. Specifically, the process enables system 100 to process at full throughput on each feeder. If the transport mechanism (i.e., conveyor 160) of system 100 were traveling at 10,000 objects per hour, then this configuration could sort at 20,000 objects per hour during the secondary sorts.

System 100 could be used to perform step 204, by feeding the set of objects using feeders 1 and 2 and separating the objects into the two subets, or any other sorting system capable of handling the objects could perform the primary (or "first pass sort").

Figure 3:
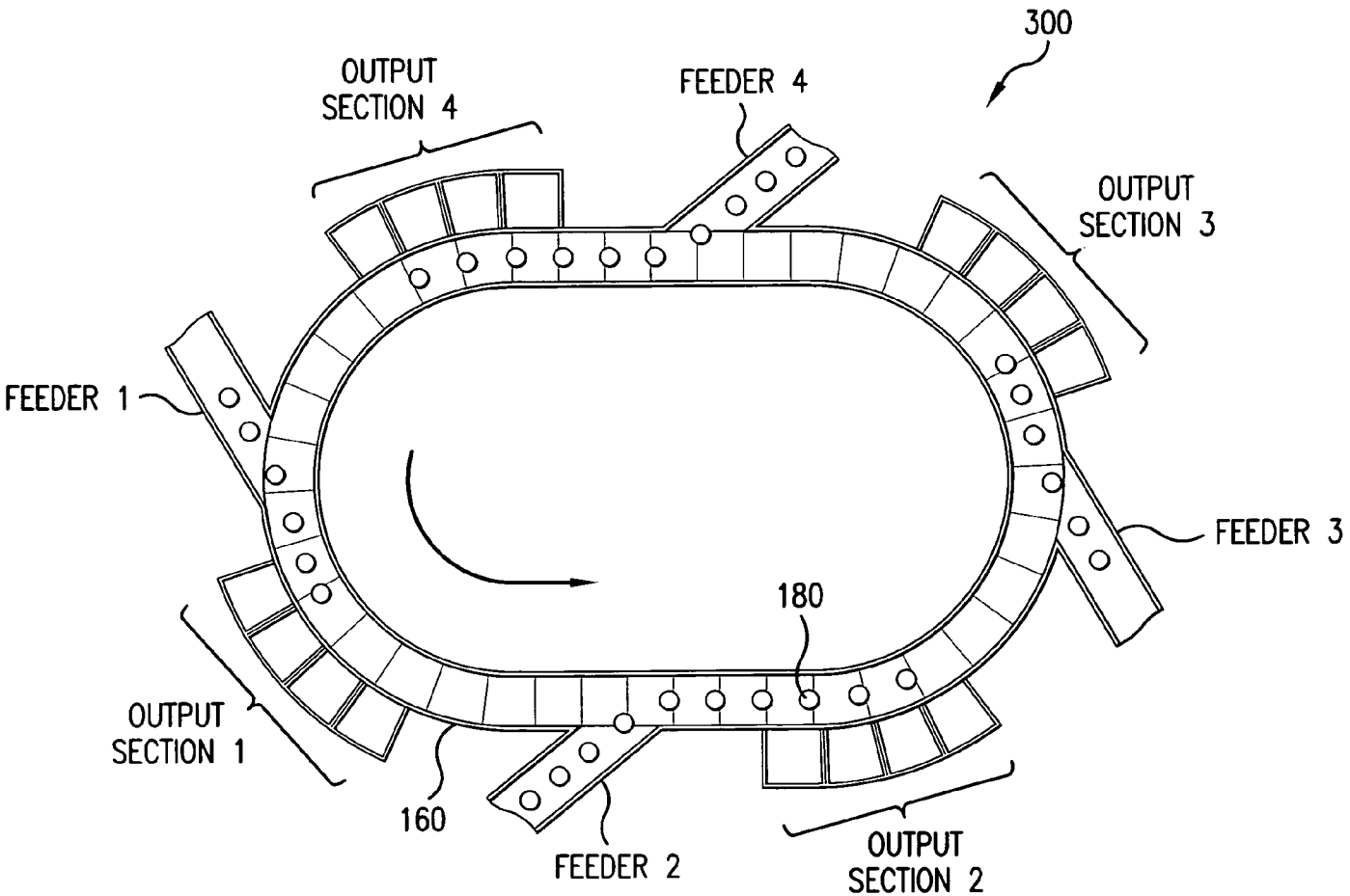
FIG. 3 illustrates an object sorting system 300 having multiple feeders.

Increasing the number of feeders and output sections and presorting the objects to be sorted into the appropriate subsets in a primary sort can provide for even great throughput. For example, for system 300 (see FIG. 3), which has four feeders and four output sections the throughput could be quadrupled.

System 300 would be used in cases where an unordered set of objects includes four subsets (e.g., a set of parcels where some parcels are destined for Canada, some for Mexico, some for Europe and some for Asia). In such a situation, the unordered set of objects is sorted into the at least these four subsets such that all of the parcels for Mexico are physically grouped together, all of the parcels for Canada are physically grouped together, all of the parcels for Europe are physically grouped together, and all of the parcels for Asia are physically grouped together. Each grouping is assigned to one of the output sections and then fed onto conveyor using the feeder that is immediately upstream from the output section. For example, if the Mexico grouping is assigned to output section 4, then the Mexico grouping of objects should be fed onto conveyor using feeder 4, which is the feeder that is immediately upstream from output section 4.

Figure 4:
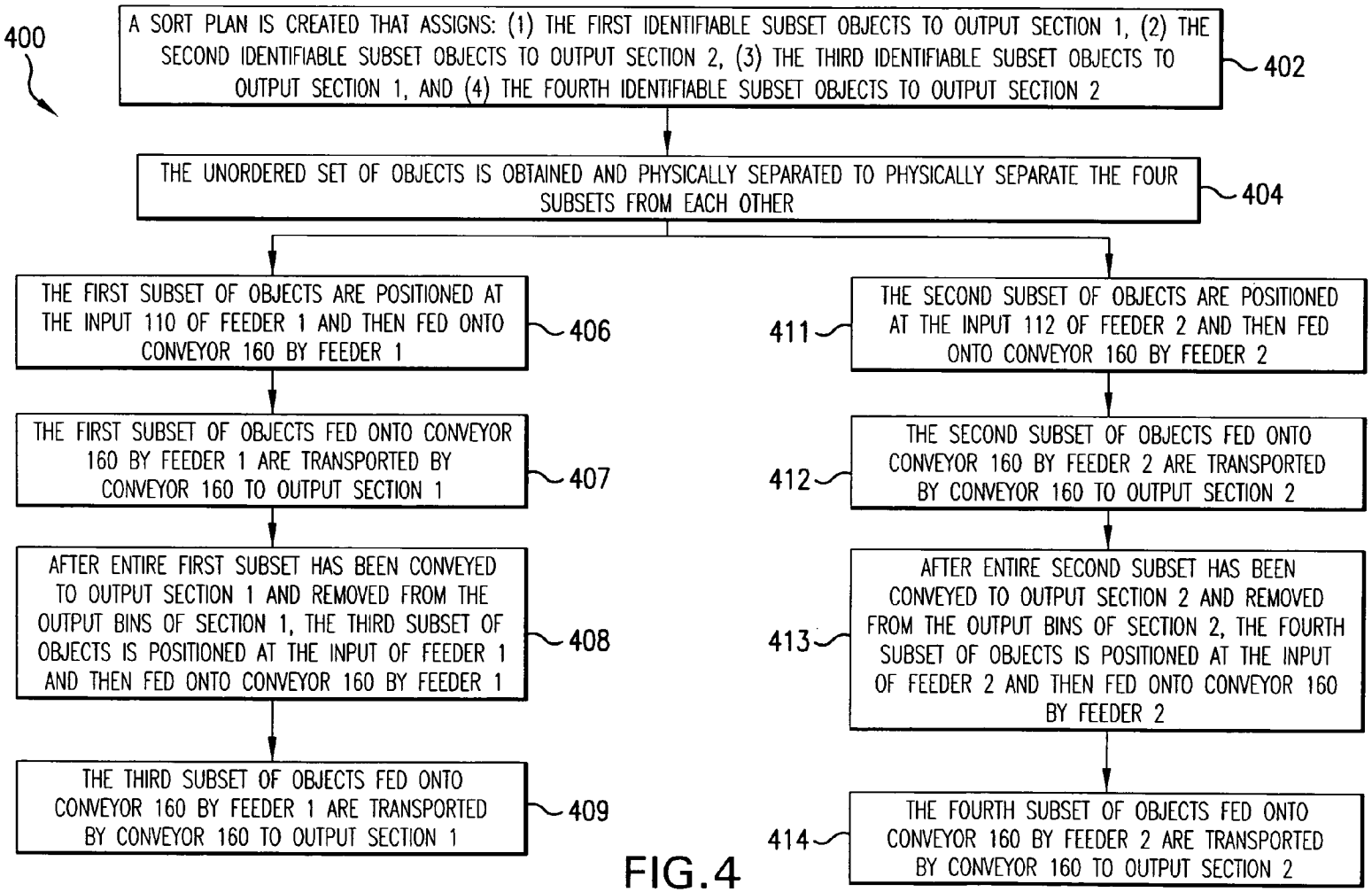
FIG. 4 is flow chart illustrating a process 400.

It should be noted that, even though system 100 includes only two feeders and two output sections, system 100 can be used to sort an unordered set of objects that includes more than two identifiable subsets of objects. FIG. 4 is a flow chart illustrating a process 400 according to an embodiment wherein system 100 is used to sort an unordered set of objects that includes four identifiable subsets of objects. A similar process can be applied to system 300 to enable it to sort an unordered set of objects that has more than four identifiable subsets.

Process 400 may being in step 402, where a sort plan is created that assigns: (1) the first identifiable subset objects to output section 1, (2) the second identifiable subset objects to output section 2, (3) the third identifiable subset objects to output section 1, and (4) the fourth identifiable subset objects to output section 2.

In step 404, the unordered set of objects is obtained and physically separated to physically separate the four subsets from the each other.

In step 406, the first subset of objects is positioned at the input of feeder 1 and then fed onto conveyor 160 by feeder 1.

In step 407, the objects fed onto conveyor 160 by feeder 1 are transported by conveyor 160 to the output section 1. Because of the positions in which the feeders and output sections are arranged around conveyor 160, these objects will not pass the point at which feeder 2 places objects onto conveyor 160 because these objects are removed from conveyor at output section 1.

In step 408, after entire first subset has been conveyed to output section 1 and removed from the output bins of section 1, the third subset of objects is positioned at the input of feeder 1 and then fed onto conveyor 160 by feeder 1.

In step 409, the third subset of objects fed onto conveyor 160 by feeder 1 are transported by conveyor 160 to the output section 1.

In step 411, the second subset of objects is positioned at the input of feeder 2 and then fed onto conveyor 160 by feeder 2.

In step 412, the objects fed onto conveyor 160 by feeder 2 are transported by conveyor 160 to the output section 2. Because of the positions in which the feeders and output sections are arranged around conveyor 160, these objects will not pass the point at which feeder 1 deposits objects onto conveyor 160 because these objects are removed from conveyor at output section 2.

In step 413, after entire second subset has been conveyed to output section 2 and removed from the output bins of section 2, the fourth subset of objects is positioned at the input of feeder 2 and then fed onto conveyor 160 by feeder 2.

In step 414, the fourth subset of objects fed onto conveyor 160 by feeder 2 are transported by conveyor 160 to the output section 2.

Process steps 406-409 may be performed at the same time as process steps 411-414.

An advantage of the above processes is increased throughput. Thus, it is possible to operate conveyor 160 at a speed well below its maximum speed and still be able to process the same number of objects in a given time period. For example, if in a conventional system the speed of conveyor must be X in in order to process Y number of objects in a hour, with the present invention the speed may of conveyor 160 may be set to X/Z (Z>1) while still being able to process Y number of objects in a hour.

While the processes described herein have been illustrated as a series or sequence of steps, the steps need not necessarily be performed in the order described, unless indicated otherwise.

Further, while various embodiments of the present invention have been described above, it should be understood that they have been presented by way of example only, and not limitation. Thus, the breadth and scope of the present invention should not be limited by any of the above-described exemplary embodiments.

What is claimed is:

1. In an environment comprising an object sortation system comprising a conveyor, a first object feeder for feeding objects onto the conveyor, a second object feeder for feeding objects onto the conveyor, a first output section arranged between the first object feeder and the second object feeder and having a first plurality of output bins, and a second output section positioned downstream from the second object feeder and having a second plurality of output bins, wherein the conveyor is configured to convey objects such that an object fed onto the conveyor by the first object feeder must first pass the first output section prior to passing the point at which the second object feeder feeds objects onto the conveyor, a method comprising the steps of:

obtaining a plurality of objects comprising a first subset of objects and a second subset of objects, wherein each object within the first subset of objects has a first attribute and each object within the second subset of objects has a second attribute;

assigning to the first output section all of the objects of said first subset of objects;

assigning to the second output section all of the objects of said second subset of objects;

positioning the objects having the first attribute at an input of the first object feeder;

positioning the objects having the second attribute at an input of the second object feeder;

using the first object feeder to feed onto the conveyor each of said objects having the first attribute;

using the second object feeder to feed onto the conveyor each of said objects having the second attribute;

using the conveyor to convey each of said objects having the first attribute to the first output section, wherein each of said objects having the first attribute reaches said first output section without having passed the point at which the second object feeder feeds objects onto the conveyor;

using the conveyor to convey each of said objects having the second attribute to the second output section, wherein each of said objects having the second attribute reaches said second output section without having passed the point at which the first object feeder feeds objects onto the conveyor;

when an object having the first attribute is adjacent an output bin of the first output section, removing the object from the conveyor and placing the object in the output bin of the first output section; and when an object having the second attribute is adjacent an output bin of the second output section, removing the object from the conveyor and placing the object in the output bin of the second output section.

2. The method of claim 1, wherein said plurality of objects further comprises a third subset of objects and a fourth subset of objects, wherein each object within the third subset of objects has a third attribute and each object within the fourth subset of objects has a fourth attribute.

3. The method of claim 2, further comprising:

using the first object feeder to feed onto the conveyor each of said objects having the third attribute after using said first object feeder to feed all of said objects having the first attribute onto the conveyor;

using the second object feeder to feed onto the conveyor each of said objects having the fourth attribute after using the second object feeder to feed all of said objects having the second attribute onto the conveyor.

4. The method of claim 3, further comprising:

using the conveyor to convey each of said objects having the third attribute to the first output section, wherein each of said objects having the third attribute reaches said first output section without having passed the point at which the second object feeder feeds objects onto the conveyor;

using the conveyor to convey each of said objects having the fourth attribute to the second output section, wherein each of said objects having the fourth attribute reaches said second output section without having passed the point at which the first object feeder feeds objects onto the conveyor;

when an object having the third attribute is adjacent an output bin of the first output section, removing the object from the conveyor and placing the object in the output bin of the first output section; and when an object having the fourth attribute is adjacent an output bin of the second output section, removing the object from the conveyor and placing the object in the output bin of the second output section.

5. The method of claim 1, wherein the conveyor is in the form of a closed loop.

6. The method of claim 1, wherein the step of removing an object from the conveyor comprises using a tilt tray or cross belt to remove said object from the conveyor.

7. A method for sorting objects, comprising:

obtaining a batch of objects;

sorting the batch of objects to form at least a first group of objects and a second group of objects;

after forming the first and second groups of objects, for each object within the first group of objects, (i) using a first feeder to feed the object onto a continuous loop conveyor, (ii) using the conveyor to transport the object to a first output section that is disposed downstream from the first feeder and upstream from a second feeder, and (iii) removing the object from the conveyor while the object is adjacent the first output section and placing the object in an output bin of the first output section so that the object will not reach the point on the conveyor at which the second feeder deposits objects onto the conveyor; and after forming the first and second groups of objects, for each object within the second group of objects, (i) using the second feeder to feed the object onto a continuous loop conveyor, (ii) using the conveyor to transport the object to a second output section that is disposed downstream from the second feeder and upstream from the first feeder, and (iii) removing the object from the conveyor while the object is adjacent the second output section and placing the object in an output bin of the second output section so that the object will not reach the point on the conveyor at which the first feeder deposits objects onto the conveyor.

8. The method of claim 7, wherein the step of using the second feeder to feed the objects from the second group of objects onto the continuous loop conveyor is performed concurrently with the step of using the first feeder to feed the objects from the first group of objects onto the continuous loop conveyor.

9. The method of claim 7, comprising:

sorting the batch of objects to form a third group of objects and a fourth group of objects in addition to the first group of objects and the second group of objects.

10. The method of claim 9, comprising:

after forming the third group of objects, for each object within the third group of objects, (i) using a third feeder to feed the object onto the continuous loop conveyor, (ii) using the conveyor to transport the object to a third output section that is disposed downstream from the third feeder and upstream from the first feeder, the second feeder and a fourth feeder, and (iii) removing the object from the conveyor while the object is adjacent the third output section and placing the object in an output bin of the third output section so that the object will not pass the third output section; and after forming the fourth group of objects, for each object within the fourth group of objects, (i) using the fourth feeder to feed the object onto the continuous loop conveyor, (ii) using the conveyor to transport the object to a fourth output section that is disposed downstream from the fourth feeder and upstream from the first feeder, the second feeder and the third feeder, and (iii) removing the object from the conveyor while the object is adjacent the fourth output section and placing the object in an output bin of the fourth output section so that the object will not pass the fourth output section.

11. The method of claim 9, comprising:

after all of the objects within the first group of objects have been deposited onto the conveyor, for each object within the third group of objects, (i) using the first feeder to feed the object onto the continuous loop conveyor, (ii) using the conveyor to transport the object to the first output section, and (iii) removing the object from the conveyor while the object is adjacent the first output section and placing the object in an output bin of the first output section so that the object will not reach the point on the conveyor at which the second feeder deposits objects onto the conveyor.

12. The method of claim 11, comprising:

after all of the objects within the second group of objects have been deposited onto the conveyor, for each object within the fourth group of objects, (i) using the second feeder to feed the object onto the continuous loop conveyor, (ii) using the conveyor to transport the object to the second output section, and (iii) removing the object from the conveyor while the object is adjacent the second output section and placing the object in an output bin of the second output section so that the object will not reach the point on the conveyor at which the first feeder deposits objects onto the conveyor.

13. The method of claim 12, wherein the step of using the second feeder to feed the objects from the fourth group of objects onto the continuous loop conveyor is performed concurrently with the step of using the first feeder to feed the objects from the third group of objects onto the continuous loop conveyor.

14. The method of claim 13, wherein the batch of objects comprises a plurality of parcels.

* * * * *